US009528287B2

(12) United States Patent
Gosling et al.

(10) Patent No.: US 9,528,287 B2
(45) Date of Patent: Dec. 27, 2016

(54) ANGLED WALL CONNECTION DEVICES, SYSTEMS, AND METHODS

(71) Applicant: DIRTT Environmental Solutions, Ltd., Calgary (CA)

(72) Inventors: Geoff Gosling, Calgary (CA); Mogens Smed, DeWinton (CA)

(73) Assignee: DIRTT Environmental Solutions, LTD., Calgary (CA)

( * ) Notice: Subject to any disclaimer, the term of this patent is extended or adjusted under 35 U.S.C. 154(b) by 0 days.

(21) Appl. No.: 14/119,845

(22) PCT Filed: Jun. 10, 2013

(86) PCT No.: PCT/US2013/045047

§ 371 (c)(1),
(2) Date: Nov. 22, 2013

(87) PCT Pub. No.: WO2014/200462

PCT Pub. Date: Dec. 18, 2014

(65) Prior Publication Data

US 2016/0201320 A1 Jul. 14, 2016

Related U.S. Application Data

(63) Continuation-in-part of application No. 29/457,414, filed on Jun. 10, 2013.

(51) Int. Cl.

| | |
|---|---|
| ***E04H 1/12*** | (2006.01) |
| ***E04B 2/72*** | (2006.01) |
| *E04B 1/348* | (2006.01) |

(52) U.S. Cl.

CPC ..... *E04H 1/12* (2013.01); *E04B 2/721* (2013.01); *E04H 1/1205* (2013.01);
(Continued)

(58) Field of Classification Search

CPC .... E04B 2/721; E04B 2/7401; E04B 1/34384; E04B 1/3483; E04B 1/34321; E04H 1/1205; E04H 1/1211; E04H 1/1216; E04H 1/1222; E04H 1/1227; E04H 1/1233; E04H 1/1238; E04H 1/1244
(Continued)

(56) References Cited

U.S. PATENT DOCUMENTS 3,283,693 A * 11/1966 Howell ..... E04H 1/02 454/186
3,354,590 A * 11/1967 Gilroy ..... E04B 1/24 52/299

(Continued)

FOREIGN PATENT DOCUMENTS

WO WO2013040016 3/2013

OTHER PUBLICATIONS

International Search Report and Opinion, PCT/US2013/045047, Mailed Mar. 3, 2014.

(Continued)

*Primary Examiner* — Brian Mattei
*Assistant Examiner* — Paola Agudelo
(74) *Attorney, Agent, or Firm* — Workman Nydegger

(57) ABSTRACT

Implementations of the present invention relate to systems, methods, and apparatus for forming individual spaces within a building. More specifically, implementations can involve partitions and/or walls that can define an individual space, which can produce a perception for occupants that the individual space is larger than actual dimensions thereof. As such, the occupants of the individual space can have a perception or experience of being in an individual space that is non-confining or less confining than a conventional individual space.

20 Claims, 5 Drawing Sheets

(52) U.S. Cl.
CPC ..... *E04H 1/1211* (2013.01); *E04H 1/1244* (2013.01); *E04B 1/3483* (2013.01)

(58) Field of Classification Search
USPC ..... 52/79.1
See application file for complete search history.

(56) References Cited

U.S. PATENT DOCUMENTS 3,385,013 A * 5/1968 Severson ..... E04B 1/26 52/11
3,460,297 A * 8/1969 Fritz ..... E04B 1/3442 296/173
3,942,290 A * 3/1976 O'Sheeran ..... E04B 1/6137 52/57
3,972,163 A 8/1976 Coperthwaite
4,024,682 A * 5/1977 Jamison ..... E04B 7/20 52/294
4,207,714 A * 6/1980 Mehls ..... E04B 1/0007 52/79.1
4,361,993 A * 12/1982 Simpson ..... E04B 1/14 52/222
4,951,432 A * 8/1990 Wilkinson ..... E04B 1/3211 52/79.5
5,501,046 A * 3/1996 Hattingh ..... E04B 1/34321 52/266
5,801,958 A 9/1998 Dangelo
6,357,550 B1 * 3/2002 Willson ..... E04H 1/1205 182/131
6,580,426 B1 6/2003 Small
6,629,065 B1 9/2003 Gadhi
7,099,803 B1 8/2006 Rappoport
7,921,610 B2 * 4/2011 Boatwright ..... E04B 1/24 52/639
8,881,479 B2 * 11/2014 McClure ..... E04B 1/66 52/404.1
2004/0075655 A1 4/2004 Dunnett
2004/0174358 A1 9/2004 Takagi
2005/0072059 A1 4/2005 Hodsdon
2007/0109310 A1 5/2007 Xu
2007/0276791 A1 11/2007 Fejes
2009/0000213 A1 * 1/2009 Coopman ..... E04H 1/1205 52/79.5
2010/0018141 A1 1/2010 Kelly
2011/0227924 A1 9/2011 Nakajima
2011/0265405 A1 11/2011 Ksenych
2013/0033222 A1 * 2/2013 Hixson ..... H02J 7/00 320/101

OTHER PUBLICATIONS

International Search Report and Opinion, PCT/US2013/043735, Mailed Feb. 27, 2014.
International Search Report and Opinion, PCT/US2013/050764, Mailed Feb. 27, 2014.

* cited by examiner

ANGLED WALL CONNECTION DEVICES, SYSTEMS, AND METHODS

CROSS-REFERENCE TO RELATED APPLICATIONS

The present invention is a 35 U.S.C. §371 U.S. National Stage of PCT Application No. PCT/US2013/045047 entitled "Angled Wall Connection Devices, Systems, and Methods," filed Jun. 11, 2013, which claims priority to U.S. Design patent application No. 29/457,414 entitled "Building Structure," filed Jun. 10, 2013. The entire content of each of the aforementioned patent applications is incorporated herein by reference.

BACKGROUND OF THE INVENTION

1. The Field of the Invention

This invention relates to systems, methods, and apparatus for connecting panels, such as panels of wall modules, partitions, and walls, including modular walls.

2. Background and Relevant Art

Commonly, the general shape of a building can constrain the shape of an office or a living space. For instance, a typical building can have approximately vertical walls and approximately horizontal floors and ceilings, which can define the building's envelope. Particularly, the walls can be approximately perpendicular to the floors and ceilings. Hence, the shape of interior spaces, such as office or living spaces, can be at least partially defined by the exterior shape of the building's envelope.

Typical buildings also can include internal partitions or walls, which can define individual spaces within the building. For example, a number of partitions can define office spaces, conference rooms, utility rooms, etc. Usually, partitions or walls that define individual spaces also have approximately perpendicular orientation relative to the building's floor. As such, in some instance, occupants of the individual spaces may have a perception of confinement. Accordingly, there are a number of disadvantages in modular walls and partitions that can be addressed.

BRIEF SUMMARY OF THE INVENTION

Implementations of the present invention provide systems, methods, and apparatus for forming individual spaces within a building. More specifically, implementations can involve partitions and/or walls that can define an individual space, which can produce a perception for occupants that the individual space is larger than actual dimensions thereof. As such, the occupants of the individual space can have a perception or experience of being in an individual space that is non-confining or less confining than a conventional individual space.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention provide systems, methods, and apparatus for forming individual spaces within a building. More specifically, implementations can involve partitions and/or walls that can define an individual space, which can produce a perception for occupants that the individual space is larger than actual dimensions thereof. As such, the occupants of the individual space can have a perception or experience of being in an individual space that is non-confining or less confining than a conventional individual space.

For example, the walls that define the individual space can include one or more angled panels oriented at a non-orthogonal angle relative to a floor and/or a ceiling of such individual space. Particularly, in at least one implementation, the angled panels can form an obtuse angle with an interior portion of the floor (i.e., relative to the floor inside the individual office space). Accordingly, the angled panels also can form an acute angle with an interior portion of the ceiling, which is parallel to the interior portion of the floor. In any event, the angled panels can angle outward from the interior of the individual space.

Consequently, the walls formed by the angled panels can provide an increased space at an upper portion of the individual space as compared with the lower portion thereof. Increased space in the upper portion of the individual space (i.e., the volume differential between the upper and lower portions) may provide a perception of openness inside the individual space. Moreover, volume differential between the upper and lower portions can provide an appearance that the individual space is larger than the actual dimensions thereof.

Additionally, implementations can include modular or non-modular walls. In other words, the walls may have one or more wall modules, which can connect together in any number of suitable configurations, to form modular walls. Similarly, in at least one implementation, a single wall module can include one or more angled panels secured thereto or incorporated therein. In alternative or additional implementations, the angled panels can couple to and/or between multiple wall modules. In any case, however, the builder or installer can easily position and reposition wall modules and/or the angled panels to configure and/or reconfigure the shape, use, or any number of other parameters of an individual space.

Figure 1A:
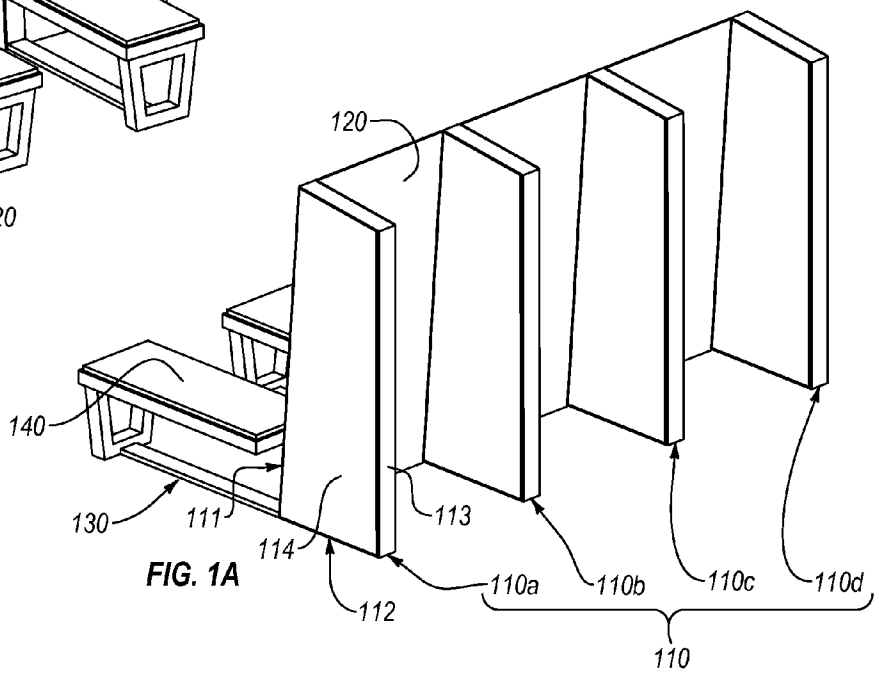
FIG. 1A illustrates a perspective view of a wall module in accordance with one implementation of the present invention.
Figure 1B:
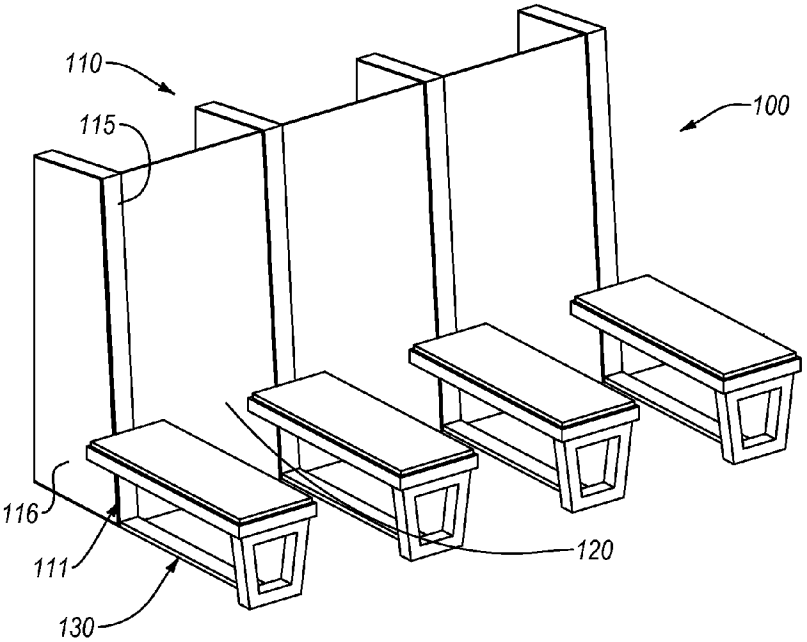
FIG. 1B illustrates another perspective view of the wall module of FIG. 1A.

FIGS. 1A-1B illustrate an exemplary modular wall 100. For convenience of description, references will be made to the modular wall 100. It should be appreciated, however, that a wall installation may be modular or non-modular (e.g., a permanent installation), unless specifically described otherwise. In one implementation, the modular wall 100 can include one or more vertical supports, such as vertical supports 110 (e.g., vertical supports 110*a*, 110*b*, 110*c*, 110*d*). Implementations also can include angled panels 120 connected to and between the vertical supports 110.

For example, the vertical supports 110 can have an angled face 111 and a base 112. Particularly, the angled face 111 can be oriented at an acute angle relative to the base 112. For example, the angled face 111 can face an interior of the individual space. Accordingly, the angled face 111 can be angled outward relative to the interior of the individual space. The installer can position or set the base 112 on a support surface, such as a floor.

The vertical supports 110 can have any number of suitable configurations, which can vary from one implementation to another. For instance, the base 112 of the vertical supports 110 can have a width of about 12" to 36". Hence, in one or more implementations, the vertical supports 110 can include a frame and multiple panels (e.g., panels 113, 114, 115, 116) connected to the frame in a manner that at least partially conceals the frame. It should be appreciated that in some instances the panel 115 can form or define the angled face 111. In any event, the builder or installer can form the vertical supports 110 that have any suitable appearance. Specifically, the builder can choose a suitable color, pattern, transparency or translucency, and other appearance characteristics for the panels that connect to the frame of the vertical supports 110.

It should be appreciated that the panels can removably connect to the vertical supports 110. Consequently, the panels can detach from the frame of the vertical supports 110 to allow for reconfiguration of the vertical supports 110. Particularly, after detaching current panels from the frame of the vertical supports 110, the installer can connect replacement panels thereto. Hence, for example, the installer can match and/or coordinate the panels of the vertical supports 110 with interior of the individual space.

Moreover, the panels of the vertical supports 110 also can provide additional support and/or rigidity for the vertical supports 110. Accordingly, the frame of the vertical supports 110 can be smaller than a similar vertical support that does not include panels. In any event, the vertical supports 110 can have sufficient strength and/or rigidity to support the angled panels 120.

More specifically, in at least one implementation, the angled panels 120 can connect to the angled face 111 of the vertical supports 110. For example, the angled panels 120 may be oriented approximately parallel relative to the angled face 111 of the vertical supports 110. As such, the angled panels 120 can form an obtuse angle with the floor inside the individual space.

The angled panels 120 can connect to the vertical supports 110 in any number of suitable ways. For example, the installer can fasten the angled panels 120 to the vertical supports 110 (e.g., with screws, bolts, rivets, etc.). In some instances, the angled panels 120 can detachably or removably connect to the vertical supports 110. Accordingly, the installer can detach and/or replace the angled panels 120 from the modular wall 100. Consequently, the installer can easily modify the configuration of the modular wall 100 into any suitable configuration.

Moreover, the angled panels 120 can connect to the vertical supports 110 in any number of suitable locations and orientations. For example, the angled panels 120 can pass through the panel 114 and panel 115 of each of the vertical supports 110 and can connect to the frame and/or to the panel 114 and/or panel 115 of the vertical supports 110. Accordingly, the panels 114, 115, and the angled panels 120 can interconnect together and can increase rigidity and stability of the modular wall 100.

Although the angled panels 120 are shown as substantially planar, it should be appreciated that this disclosure is not so limited. In one example, the angled panels 120 can have a non-planar configuration. For instance, the angled panels 120 can have a waive-like shape.

The angled panels 120 can comprise any number of materials, which may vary from one implementation to another. In one example, the angled panels 120 can include glass, thermoplastic resin, similar material, or combinations thereof, which can be at least partially transparent and/or translucent. It should be appreciated, however, that the angled panels 120 can include any number of materials that may be opaque or substantially opaque. In any case, the installer can coordinate the selection of suitable angled panels 120 with, for example, the design of the building and/or of the individual space by connecting suitable angled panels 120 to the vertical supports 110.

In one or more implementations, the angled panels 120 can include substantially rigid materials. Alternatively, however, the angled panels 120 can include flexible and/or sheet-like materials. For example, the angled panels 120 can comprise a fabric, film, or similar thin and/or flexible material. Furthermore, the angled panels 120 comprising a thin and/or flexible material can be stretched between adjacent vertical supports 110 (e.g. between the vertical supports 110*a* and the vertical supports 110*b*), such that the angled panels 120 acquire and maintain a substantially planar configuration or shape. Alternatively, the angled panels 120 may be partially stretched between the adjacent vertical supports 110, in a manner that at least a portion of the angled panels 120 sags or droops out of the planar configuration.

Furthermore, the particular shape of the vertical supports 110, angled panels 120, and/or of the modular wall 100 can vary from one implementation to the next and can depend, for example, on particular suitability for a specific installation and/or individual space. In one example, the angled panels 120 and/or the modular wall 100 may have an approximately rectangular shape. Additional or alternative implementations can include the angled panels 120 that have a square, oval, or any number of suitable shapes.

Moreover, it should be appreciated that the angled panels 120 can completely or partially cover the space between the adjacent vertical supports 110. For instance, the angled panels 120 together with the vertical supports 110 can form a substantially uninterrupted modular wall 100. Alternatively, however, the angled panels 120 may partially cover or close the space between the adjacent vertical supports 110, such as to leave an opening. For example, a bottom of the angled panels 120 may be offset from the floor, in a manner that forms a gap between the floor and the bottom of the angled panels 120. Also, the angled panels 120 may have a shape that is different from the shape formed by the space between the vertical supports 110 (e.g., an oval shape), and the difference between the shapes can form one or more openings in the modular wall 100.

In one or more implementations, the modular wall 100 includes the angled panels 120 oriented at an obtuse angle relative to the floor of the individual space. As mentioned above, the angled panels 120 can connect to the base 112, which may define the angle between the angled panels 120 and the floor. In at least one implementation, the angled panels 120 can connect to one or more other portions of the vertical supports 110 (e.g., angled panels 120 may pass through the vertical supports 110). Thus, the angled panels 120 may be oriented relative to the floor at a different angle than the base 112.

For instance, the base 112 can be approximately parallel to the floor, while the angled panels 120 may form an acute or obtuse angle with the floor. Alternatively, the angled panels 120 may be approximately perpendicular relative to the floor. In any event, the angled panels 120 can connect to the vertical supports 110, while a portion of the vertical supports 110 and/or the angled panels 120 that define the individual space can have a suitable orientation relative to the floor in such individual space.

In at least one implementation, the vertical supports 110 may have sufficient length and/or width (i.e., length and width of the base 112) to provide sufficient stability to the modular wall 100 without any additional connections or structures to secure the modular wall 100. For instance, once interconnected together with the angled panels 120, the vertical supports 110 can have sufficient stability to stand on their own without any additional connections. In one or more implementations, for additional stability, the base 112 of the vertical supports 110 can connect to the floor (e.g., the installer can bolt or otherwise anchor the base 112 to the floor).

In additional or alternative implementations, the modular wall 100 can include a weighted support extension 130, which can increase the stability of the modular wall 100. In one implementation, the weighted support extension 130 can extend away from the base 112 and into the individual space. Additionally or alternatively, the weighted support extension 130 can extend away from the base 112 and may remain outside or on the exterior of the individual space. In any event, the weighted support extension 130 can increase the surface area of the modular wall 100 that is in contact with the floor, thereby increasing the stability of the modular wall 100 relative to the floor.

In one or more implementations, the weighted support extension 130 can connect (e.g. bolt or otherwise anchor) to the floor, thereby securing the modular wall 100 to the floor. Alternatively, however, the weighted support extension 130 can have sufficient weight and/or surface area to provide stability to the modular wall 100 relative to the floor. Consequently, the installer can easily position and reposition the modular wall 100 to configure and reconfigure individual spaces without damaging or otherwise modifying the floor for anchoring the modular wall 100 thereto.

Moreover, the modular wall 100 also can provide one or more functional components for the occupants of the individual space and/or for the occupants of the building generally. For instance, the weighted support extension 130 can include a bench or a seating surface 140. In additional or alternative implementations, the weighted support extension 130 can include a work surface (e.g., a desk, a table, etc.), a storage compartment, a bed (e.g., a bunk bed), and the like. As noted above, the weighted support extension 130 and functional components connected thereto or defined thereby can be on the interior and/or on the exterior of the individual space.

Additional or alternative implementations can include any number of features or elements that can secure and/or stabilize the vertical supports 110 relative to the floor. For instance, one or more guy-wires can connect any of the vertical supports 110 to the floor, the ceiling, and/or each other, thereby providing sufficient stability to maintain the modular wall 100 stable relative to the floor, the ceiling, and/or each other. Consequently, in some instances, the installer can secure the vertical supports 110 such that the base 112 rest on the floor and remain stable relative thereto. Alternatively, the installer can abut a top portion of the vertical supports 110 against the ceiling and/or can suspend the vertical supports 110 between the floor and the ceiling with guy-wires.

Similarly, the weighted support extension 130 also may interconnected together to provide additional structural rigidity and/or stability for the modular wall 100. For instance, one or more guy-wires can interconnect together the weighted support extension 130 to provide additional rigidity to the modular wall 100. Also, the guy-wires can connect the weighted support extension 130 to the floor, thereby securing the modular wall 100 to the floor.

Figure 2:
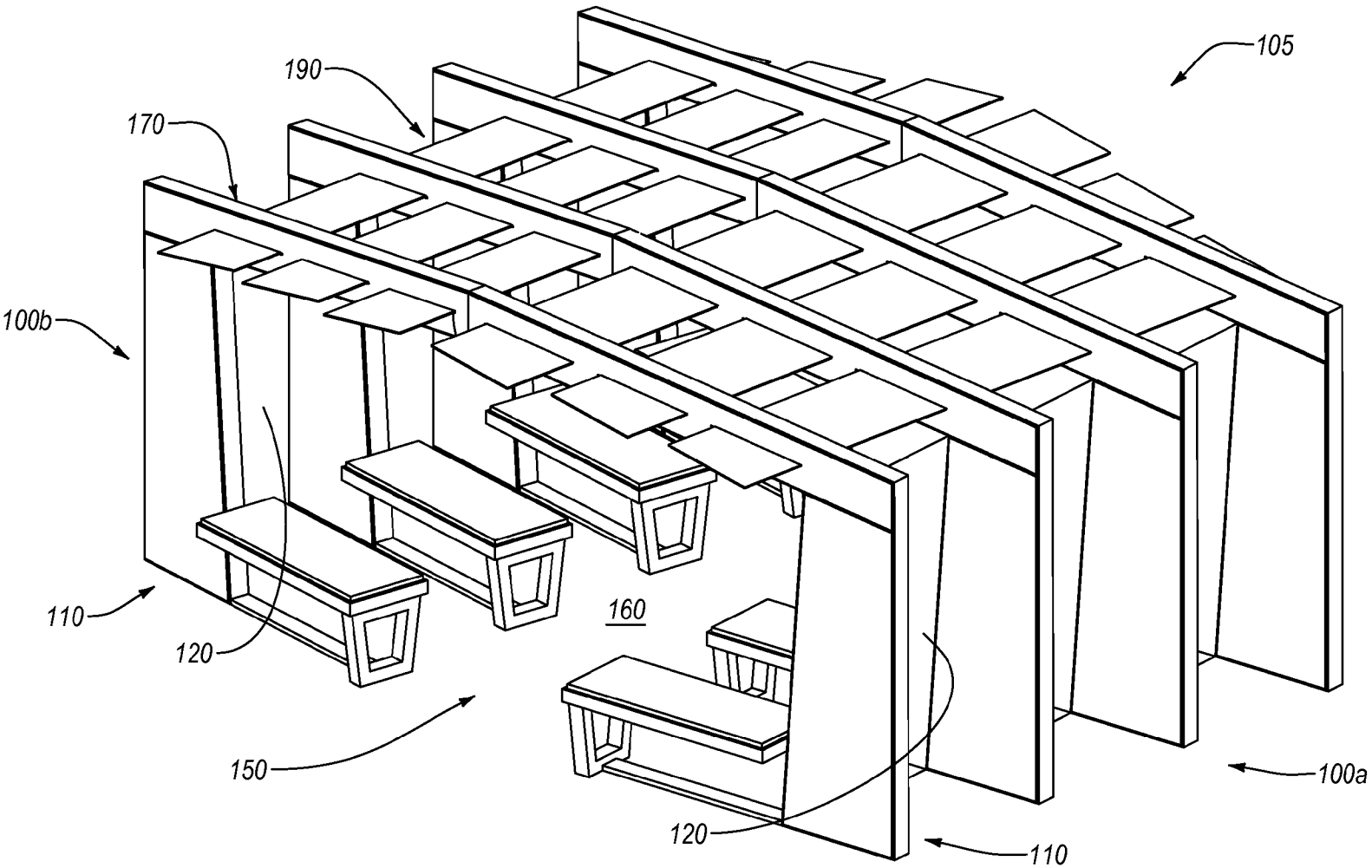
FIG. 2 illustrates a perspective view of a modular wall installation in accordance with one implementation of the present invention.
Figure 3:
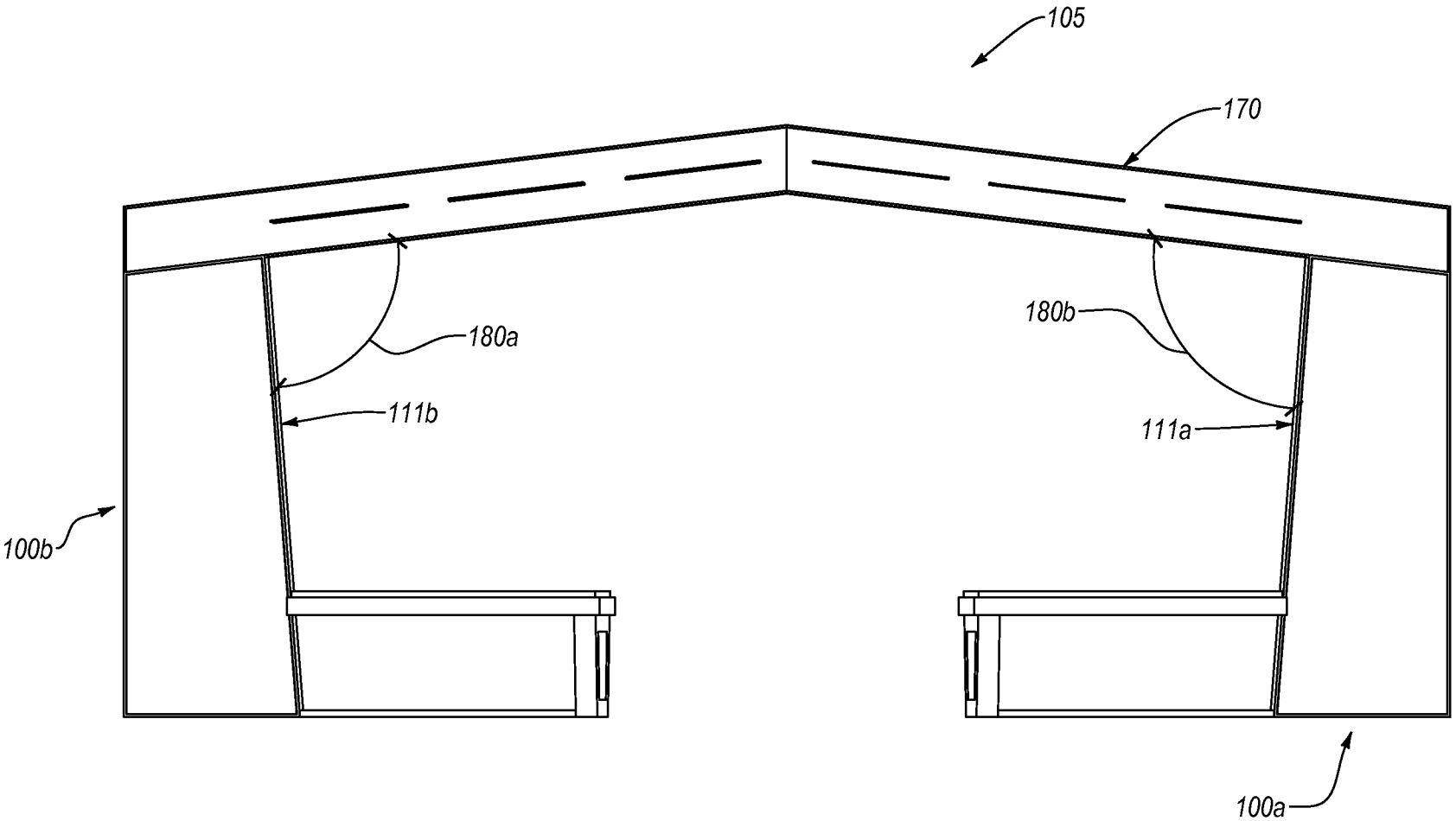
FIG. 3 illustrates a front view of the modular wall installation of FIG. 2.

As mentioned above, the modular walls can connect together to form or define an individual space. Moreover, such individual space can be fully enclosed or at least partially open. For example, FIGS. 2-3 illustrate an individual space 150 defined by a modular wall installation 105, which includes modular wall 100*a* and a modular wall 100*b*. Except as otherwise described herein, the modular wall 100*a* and the modular wall 100*b* and their respective materials, elements, or components can be similar to or the same as the modular wall 100 (FIGS. 1A-1B) and its respective materials, elements, and components. For example, each of the modular wall 100*a* and the modular wall 100*b* can comprise multiple vertical supports 110 connected together in a similar or in the same manner as in the modular wall 100 (FIGS. 1A-1B).

In some instances, the individual space 150 can have the modular walls 100*a*, 100*b* connected to and/or set on (or supported by) a floor 160 thereof. Furthermore, the modular wall 100*a* and the modular wall 100*b* can connect together with one or more connecting elements, such as crossbeams 170. The crossbeams 170 can provide additional stability and/or rigidity to the modular walls 100*a*, 100*b*. In one or more implementations, the crossbeams 170 can have a non-parallel orientation relative to the floor 160. For instance, the crossbeams 170 can have a first portion thereof oriented at a first angle 180*a* relative to an angled face 111*a* of the modular wall 100*a*, and a second portion thereof oriented at a second angle 180*b* relative to an angled face 111*b* of the modular wall 100*b*.

For example, the first and second angles 180*a*, 180*b* can be approximately 90°. Additional or alternative implementations can include the first and second angles 180*a*, 180*b* that can be acute or obtuse. Moreover, the crossbeams 170 can comprise a single unitary, elongate element or member. In additional or alternative implementations, the crossbeams 170 can include any number of interconnected elements, which together can connect the modular wall 100*a* to the modular wall 100*b*.

In one example, one, some, or each of the crossbeams 170 can include two portions connected together or integrated with one another. Such portions can connect to the respective, opposing modular walls 100*a*, 100*b*. Moreover, such portions can have a non-parallel orientation relative to each other in a vertical plane (or in a vertical direction). For instance, the first and second portions of the crossbeams 170 can form an obtuse angle therebetween. It should be appreciated that the crossbeams 170 can form any number of suitable angles in any number of planes or directions.

Furthermore, the crossbeams 170 can allow the installer to secure one or more panel thereto, which can define or form a ceiling in the individual space 150. Particularly, the top panels 190 can connect to the crossbeams 170 in a manner that forms the ceiling of the individual space 150. In one implementation, the ceiling formed by the top panels 190 can include openings between the top panels 190. Alternatively, however, the top panels 190 can form a ceiling without openings. In other words, the top panels 190 can abut one another in a manner that forms substantially uninterrupted ceiling.

Also, the top panels 190 can connect to the crossbeams 170 in any number of suitable positions and/or orientations. For example, the top panels 190 can pass through the crossbeams 170. Moreover, the top panels 190 can be oriented relative to the angled faces 111*a*, 111*b* at approximately the same angle as the top panels 190 (e.g., at the first and second angles 180*a*, 180*b*). In any event, the crossbeams 170, top panels 190, angled panels 120, and combinations thereof can connect together the individual vertical supports 110 to form the modular wall 100*a* and modular wall 100*b* that can be connected together to define the individual space 150.

Furthermore, the crossbeams 170 can have any number of suitable shapes. In one example, the crossbeams 170 can have an approximately rectangular or square cross-sectional shape. In additional or alternative implementations, the crossbeams 170 can have a C shape, a U shape, or can be an I-beam. Also, in lieu of or in addition to the crossbeams 170, the installer can connect the modular wall 100*a* and the modular wall 100*b* with one or more cables. For example, a cable can connect the modular wall 100*a* and the modular wall 100*b* together and can connect each to the floor 160 and/or to another support surface of the building. In any event, the crossbeams 170 can connect together the modular wall 100*a* and the modular wall 100*b*.

Also, it should be appreciated that the angled panels 120 positioned on the opposing modular walls 100*a*, 100*b* can have a non-parallel orientation relative to each other. More specifically, the panels 120 on the modular wall 100*a* can be at a non-parallel orientation relative to the panels 120 on the modular wall 100*b* in a vertical place or a vertical direction. For instance, the panels 120 on the modular wall 100*a* and the panels 120 on the modular wall 100*a* can form an acute angle therebetween.

Figure 4:
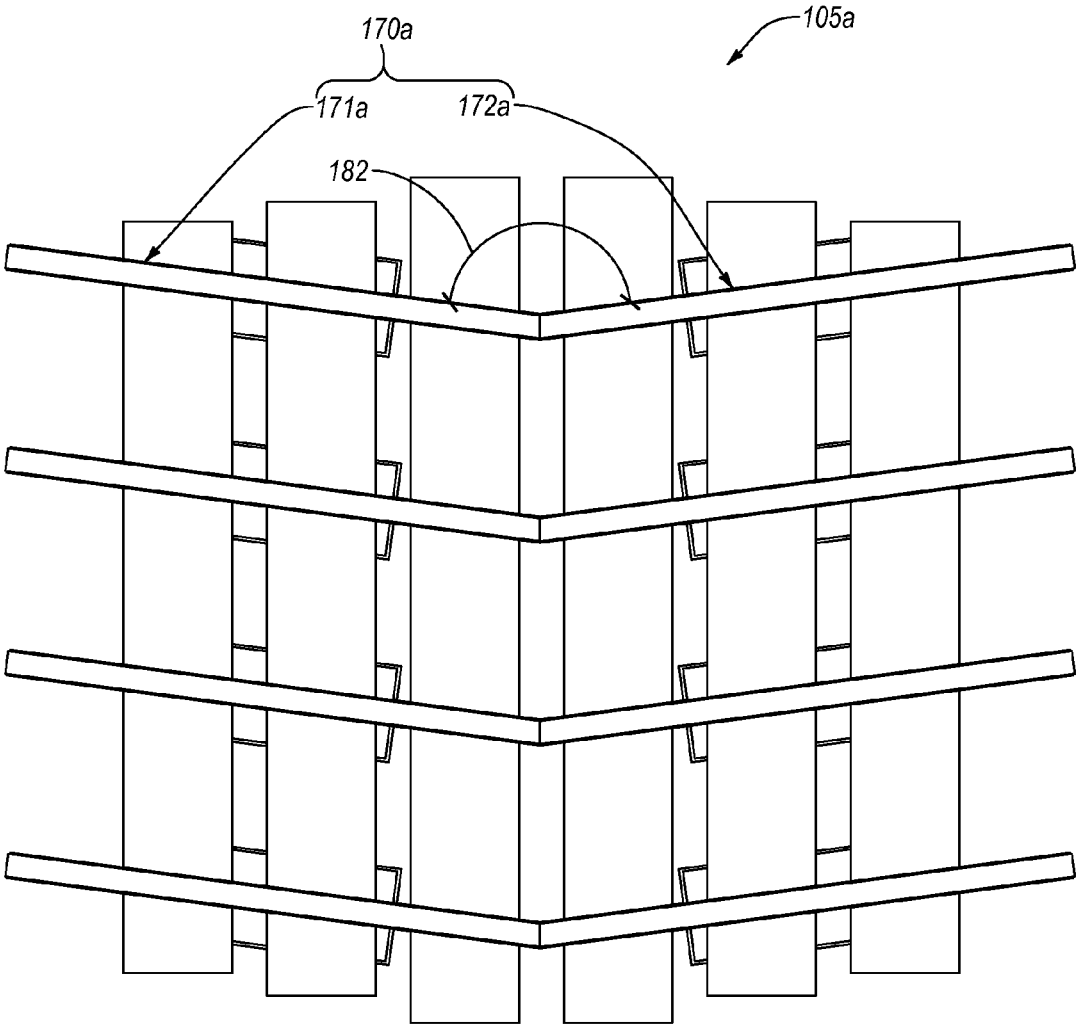
FIG. 4 illustrates a top view of a modular wall installation in accordance with one or more implementations of the present invention.

As mentioned above, the crossbeams 170 can comprise a single member or multiple members. Furthermore, the crossbeams 170 comprising multiple members can have such members oriented relative to one other in any suitable manner. Hence, the crossbeams can position and orient the respective opposing modular walls connected thereby. For instance, FIG. 4 illustrates a modular wall installation 105*a*, which has crossbeams 170*a* including a first portion 171*a*, and a second portion 172*a*. Except as otherwise described herein, the modular wall installation 105*a* and its materials, elements, or components can be similar to or the same as the modular wall installation 105 (FIGS. 2-3) and its respective materials, elements, and components. For example, the modular wall installation 105*a* can include modular walls similar to or the same as any of the modular walls 100, 100*a*, 100*b* (FIGS. 1A-3) connected together by the crossbeams 170*a*.

In one implementations, as described above, the crossbeams 170*a* can be oriented approximately perpendicular relative to the angled faces of the opposing modular walls. In other words, the first and second portions 171*a*, 172*a*, can have a nonparallel orientation relative to the floor. In addition, the 171*a*, 172*a* also can have a nonparallel orientation relative to each other. In one example, the 171*a*, 172*a* can form an angle 182, which can be an obtuse angle. Alternatively, the angle 182 can be 90° or can be an acute angle, as may be suitable for a particular installation.

Some implementations can include modular walls or portions thereof (e.g., angled panels) that have an approximate parallel orientation relative to one another in a horizontal plane. In other words, the width of the individual space defined between such opposing wall modules at any given height thereof can remain approximately constant along the length thereof. Alternatively, a nonparallel orientation of the 171*a*, 172*a* relative to each other in the horizontal plane or direction can produce or facilitate a nonparallel orientation in the horizontal plane or direction of the opposing modular walls connected by the crossbeams 170*a*. That is, a nonparallel orientation of the opposing modules can produce the width of the wall module that varies along the length thereof (e.g., the floor space of the individual space may be wider at one end as compared with the opposing end thereof).

The modular wall installations described above involved two opposing wall modules connected together. It should be appreciated that this disclosure is not so limited. Particularly, a modular wall installation can include any number of wall modules connected together. For instance, connecting together four modular walls can form an approximately square- or rectangular-shaped individual space.

Figure 5:
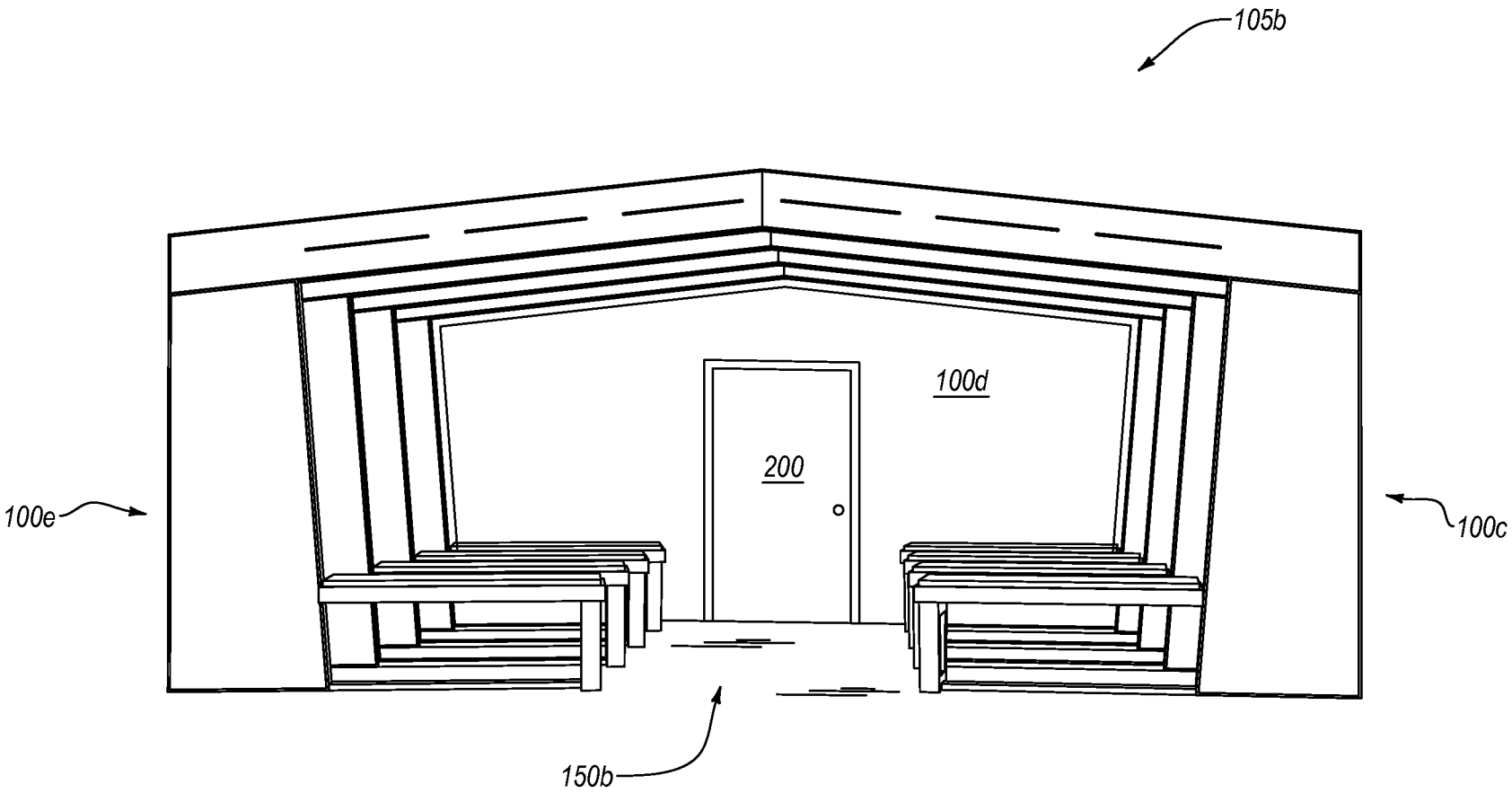
FIG. 5 illustrates a perspective view of a modular wall installation in accordance with at least one implementation of the present invention.

FIG. 5 illustrates a partial view of a modular wall installation 105*b* that includes four modular walls connected together, which define an approximately rectangular individual space 150*b*. Except as otherwise described herein, the modular wall installation 105*b* and its materials, elements, or components can be similar to or the same as any of the modular wall installations 105, 105*a* (FIGS. 2-4) and their respective materials, elements, and components. For example, the modular wall installation 105*b* can include modular walls 100*c*, 100*d*, 100*e* and a fourth modular wall (not shown) similar to or the same as any of the modular walls 100, 100*a*, 100*b* (FIGS. 1A-3) connected together by the crossbeams.

Particularly, the modular walls 100*c*, 100*d*, 100*e* and a fourth modular wall (not shown) can define a completely enclosed individual space 150*b*, which can have an approximately rectangular shape. As described above, however, the modular wall installation can have any number of wall modules that together can form any suitable shape (e.g., square, polygonal, rounded, such as round, oval, etc., and other shapes). Implementations also can include one or more doors (e.g., a door 200) or other entrance and/or exit components, which can allow an occupant to enter and exit the individual space 150*b*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A modular wall for providing partitions or forming at least a portion of an individual space, the modular wall comprising:

a first vertical support having a first base positioned on a support surface;

a second vertical support have a second base positioned on a support surface;

one or more angled panels connected to the first and second vertical supports and spanning there between; and wherein the one or more angled panels are oriented at an acute or obtuse angle relative to the support surface wherein one or more of the first and second vertical supports include a frame and one or more panels connected to the frame; and wherein the one or more angled panels pass through the one or more first and second vertical supports and through the one or more panels thereof.

2. The modular wall as recited in claim 1, wherein one or more of the first and second vertical supports further comprises at least one weighted support extension connected thereto or integrated therewith, the weighted support extension extending away from the one or more first or second vertical supports.

3. The modular wall as recited in claim 2, wherein the weighted support extension includes one or more functional components.

4. The modular wall as recited in claim 3, wherein the one or more functional components include one or more of a seating surface, a storage compartment, and a bed.

5. The modular wall as recited in claim 2, wherein one or more of the first and second vertical supports further comprise at least one angled face oriented at an acute angle relative to the base.

6. The modular wall as recited in claim 5, wherein the one or more angled panels are connected to the at least one angled face.

7. The modular wall as recited in claim 1, further comprising a first crossbeam connected to an upper end of the first vertical support and a second crossbeam connected to an upper end of the second vertical support.

8. The modular wall as recited in claim 7, further comprising one or more top panels connected between the first and second crossbeams, the one or more top panels extending through the first and second crossbeams.

9. A modular wall system for forming an individual space, the modular wall system comprising:

a first modular wall including a plurality of first vertical supports and one or more first angled panels connected to the plurality of first vertical supports;

a second modular wall including a plurality of second vertical supports and one or more second angled panels connected to the plurality of second vertical supports, the second modular wall being positioned opposite to the first modular wall;

first and second connecting elements connecting the first modular wall to the second modular wall at an upper end thereof; and one or more top panels connected to the first and second connecting elements, wherein the one or more top panels extend between and through the first and second connecting elements.

10. The modular wall system as recited in claim 9, wherein the first and second connecting elements comprise first and second crossbeams connected to respective top portions of the first and second modular walls.

11. The modular wall system as recited in claim 10, wherein the one or more crossbeams comprise a first portion connected to the first modular wall and a second portion connected to a second modular wall, the first and second portions forming an angle that is different than 180 degrees.

12. The modular wall system as recited in claim 11, the first portion being oriented approximately perpendicular relative to the one or more first angled panels and the second portion being oriented approximately perpendicular relative to the one or more second angled panels.

13. The modular wall system as recited in claim 9, wherein the one or more first angled panels have a lower end and an upper end, the one or more second angled panels have a lower end and an upper end, and wherein a distance between the lower ends of the one or more first angled panels and the one or more second angled panels differs from a distance between the upper ends of the one or more first angled panels and the one or more second angled panels.

14. The modular wall system as recited in claim 9, wherein at least some of the one or more top panels are spaced apart from each other.

15. The modular wall system as recited in claim 9, wherein the one or more first angled panels have a first vertical edge and a second vertical edge and the one or more second angled panels have a first vertical edge and a second vertical edge, wherein a distance between the first vertical edges of the one or more first angled panels and the one or more second angled panels differs from a distance between the second vertical edges of the one or more first angled panels and the one or more second angled panels.

16. The modular wall system as recited in claim 9, wherein one or more of the one or more first angled panels and the one or more second angled panels have a substantially planar configuration.

17. The modular wall system as recited in claim 9, further comprising one or more weighted support extensions connected to or integrated with one or more of the plurality of first vertical supports and the plurality of second vertical supports.

18. The modular wall system as recited in claim 17, wherein the one or more weighted support extensions extend away from the one or more of the plurality of first vertical supports and the plurality of second vertical supports into the individual space.

19. The modular wall system as recited in claim 9, wherein each of the plurality of first vertical supports includes a frame and a plurality of panels connected to the frame.

20. The modular wall system as recited in claim 9, wherein the first modular wall and the second modular wall are oriented at a non-parallel angle relative to each other.

* * * * *